US006279619B1

(12) United States Patent
Halvarsson

(10) Patent No.: US 6,279,619 B1
(45) Date of Patent: Aug. 28, 2001

(54) METHOD FOR PRELIMINARILY STORING YARN AND FEEDING DEVICE

(75) Inventor: Björn Halvarsson, Ulricehamn (SE)

(73) Assignee: IRO Patent AG, Baar (CH)

( * ) Notice: Subject to any disclaimer, the term of this patent is extended or adjusted under 35 U.S.C. 154(b) by 65 days.

(21) Appl. No.: 09/508,749

(22) PCT Filed: Sep. 15, 1998

(86) PCT No.: PCT/EP98/05870

§ 371 Date: Jun. 15, 2000

§ 102(e) Date: Jun. 15, 2000

(87) PCT Pub. No.: WO99/14149

PCT Pub. Date: Mar. 25, 1999

(30) Foreign Application Priority Data

Sep. 16, 1997 (SE) ..... 9703369

(51) Int. Cl.[7] ..... B65H 51/22
(52) U.S. Cl. ..... 139/452
(58) Field of Search ..... 139/452

(56) References Cited

U.S. PATENT DOCUMENTS 5,765,399 * 6/1998 Huss et al. ..... 139/452
6,068,028 * 6/1998 De Ro et al. ..... 139/452

FOREIGN PATENT DOCUMENTS 26 51 857 5/1978 (DE) .
327 973 2/1989 (EP) .
05-179538 7/1993 (JP) .
5-179538 7/1993 (JP) .
580 267 7/1993 (EP) .

* cited by examiner

*Primary Examiner*—Andy Falik
(74) *Attorney, Agent, or Firm*—Flynn, Thiel, Boutell & Tanis, P.C.

(57) ABSTRACT

When preliminarily storing yarn on a drum-shaped storage body of a feeding device in which the yarn is placed on the storage body by an electrical winding drive with relative rotational movements between a winding element and the storage body, with running periods and resting periods, during each resting period a holding torque is generated in the winding direction. The holding torque is generated electrically in the winding drive mechanism. A backturn detent device serves to block a reverse rotation of the winding element during resting periods. The backturn detent device is actuated by a holding current during each resting period.

8 Claims, 1 Drawing Sheet

METHOD FOR PRELIMINARILY STORING YARN AND FEEDING DEVICE

FIELD OF THE INVENTION

The present invention relates to a method and apparatus for preliminarily storing yarn on a storage body of a feeding device.

BACKGROUND OF THE INVENTION

Methods for preliminarily storing yarn and feeding devices structured for carrying out said method are known from EP-A-580 267 and EP-A-327 937. According to said documents, a stop signal for the electric winding drive and a selected position signal derived from the relative rotational movement between the winding element and the storage body are directly followed by a slow crawl speed-rotation in the winding direction. The winding drive first is braked electrically to said crawl speed and rotates slowly over a predetermined rotation angle into a predetermined rotational position until it finally stops. During the stop condition a tension force still can exist in the yarn between the winding element and the storage body. Alternatively, resilient components of said feeding device, e.g. an elastic filling body or resilient dust sealings, may generate a backturn torque in said winding drive. A backturn motion can result from this backturn torque by which the yarn of at least the first winding on the storage body gets loose and may wander over further yarn windings on the storage body. After a resting period the winding drive again is started, and said loose yarn suddenly gets stretched and might break. Alternatively, a loose part of the yarn laying on other windings may be forced to remain in said incorrect position from which a fabric fault within the textile machine might result which consumes the yarn from said feeding device. This is particularly critical in air jet weaving machines having feeding devices which by means of a stopping device release a yarn section of a predetermined length for each insertion cycle. The successively withdrawn windings are surveyed to actuate the stopping device shortly before the desired released yarn length is reached. In case of intermingled windings, single windings are difficult to detect during withdrawal, also leading to a fabric fault. The undesirable effect of a backturn motion of the winding drive during a resting period is disadvantageous for other types of feeding devices as well, e.g. for feeding devices of projectile or gripper weaving machines, particularly for multi-colour weaving with occasionally long lasting resting periods for one colour, irrespective of whether the feeding device is equipped with a stationary or a rotatable storage drum or with a storage drum having a fixed or a variable diameter. Said backturn motion may even amount to a circumferential stroke of the exit of the winding element between e.g. 3 and 7 cm.

JP-A-05 179538 discloses a method for preliminarily storing yarn on a drum-shaped storage body of a feeding device. According to this method a holding torque oriented in the winding direction is electrically generated within said winding drive prior to the beginning of a resting period. Said holding torque is maintained when said winding drive is in its stop condition and during the resting period. According to the known method the winding drive gradually slows down to a stop after a first harsh deceleration. The stop condition is maintained, even if tension in an upstream yarn section tends to turn the winding drive in the opposite direction. There is no controlled crawl speed rotation during a predetermined period of time or over a predetermined rotational angle since it is deemed to be sufficient to produce said holding torque prior to the true stop of the winding drive. Even if according to said method no backturning of the winding drive occurs, it cannot be excluded in practice that during stopping of the winding drive an upstream-loop formation will occur in the yarn and/or the winding drive will experience after run due to the early effect of the holding torque.

It is an object of the invention to provide a method of the kind as disclosed and a feeding device for carrying out said method, which avoid disturbances and damages due to a backturn motion after a stop.

Said object can be achieved by generating a holding torque within the winding drive and in the winding direction during a resting period to prevent rotation of the winding drive.

The crawl speed rotation of the winding drive during a predetermined period of time or over a predetermined rotational angle, which is intentionally controlled prior to switching on said holding torque, servres to correctly control the yarn in the run out phase and optionally also to bring the winding drive finally to a standstill at a predetermined position. The holding torque switched on first at standstill prevents relaxation or loosening of the yarn during the resting period. Since said holding torque is maintained during the resting period, the proper yarn positioning cannot change during the resting period. At a new start of the winding drive after a resting period there is no danger of a yarn breakage or a fabric fault due to a loose yarn or a winding which has fallen with respect to other windings. Said holding torque acts in addition to the system dependent, predetermined rotational resistance of the winding drive and the components coupled therewith, however, without generating any rotation in the winding direction. The winding drive, so to speak, is statically pre-biased in the winding direction after first having carried out said crawl speed rotation.

The use of the feeding device significantly reduces the quota of yarn breakages and fabric faults. This is of particular advantage in weaving machines in which pattern depending selected feeding devices have to stop for longer resting periods. The backturn detent system can be actuated by a holding current with exact timing and is, therefore, even sufficiently precise for fast running feeding devices in order to then suppress an undesired backturning. For said additional function components may be used which already are provided for control and for function purposes of the feeding device.

The holding torque is adjusted with constant magnitude and is simply controlled by a holding current or a holding voltage, respectively. The holding torque is switched on as soon as a resting period starts and is maintained during the entire resting period.

The holding torque is switched on prior to, after, or exactly at the stop. It would be ideal to switch on the holding torque shortly after the stop, e.g. some milliseconds later, in order to have a co-operation of the mechanical, friction depending starting torque of the winding drive which for physical reasons first occurs in both rotational directions with the actual stop condition. However, this may be complicated to control, as the precise point in time of the mechanical stop of the feeding device must be detected and then the generation of the holding torque must be matched therewith.

In one embodiment holding torque is adjusted depending upon the yarn quality and/or mechanical rotational resistance. It is adjusted to completely or at least largely compensate for the expected backturn torque, but not to cause further rotation in the winding direction.

The frequency is raised by a multiple while simultaneously the voltage is lowered in order to avoid a step function when switching on the holding torque. Said measure allows one to adjust and maintain the holding torque precisely.

The holding torque is controlled by a microprocessor of the electrical control device. Said microprocessor is prepared at its software side for said task. Microprocessors and control electronics as usually employed in feeding devices are capable of fulfilling said additional task without the need for structural modifications of the feeding device.

Even with the holding torque, under certain operating conditions occasionally a slight backturn motion or a slight rotation in the winding direction might occur. However, this is tolerable within the frame of the solution of the task of the invention, since the operational safety already is significantly improved when backturning is avoided with substantial reliability or does occur only seldom and to a lesser extent.

BRIEF DESCRIPTION OF THE DRAWINGS

An embodiment of the invention will be described wiLh reference to the drawings, in which.

DETAILED DESCRIPTION

Figure 1:
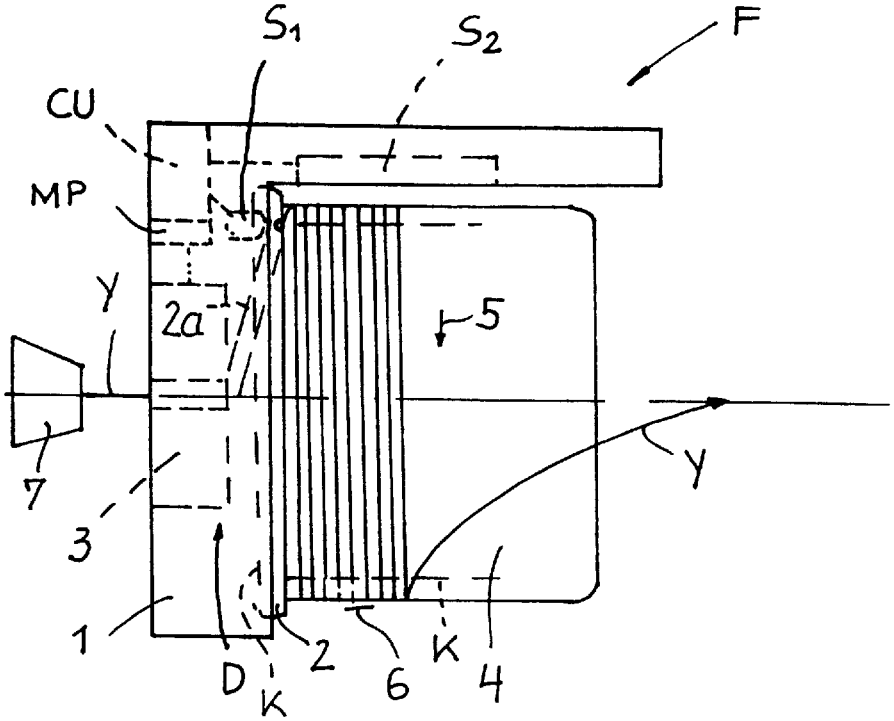
FIG. 1 is a schematic side view of a feeding device.

A feeding device F as shown in FIG. 1 serves to preliminarily store yarn Y during a yarn feeding process to a consumer, e.g. a weaving machine, which processes the yarn Y as a weft yarn. The feeding device F, with another design, could be used for a knitting machine as well. In a housing 1 a winding element 2 is provided and can be rotated in relation to a drum-shaped, stationary storage body 4 by means of a winding drive 3, e.g. an asynchrone motor. The yarn Y is withdrawn from a storage bobbin 7 and brought through a hollow shaft and an oblique winding tube 2*a* to the outer circumference of the storage body 4 and thereupon is wound tangentially in adjacent windings 6. The not shown consumer intermittently withdraws the yarn from said windings 6. An electronic control device CU is connected to the winding drive 3 and contains, e.g. a microprocessor MP.

An optionally provided sensor S1 is generating signals representing the rotational position of the winding element 2. A further sensor S2 may be provided to detect the number of the yarn windings 6 or the size ot the yarn store formed by said yarn windings on the storage body 4 and outputs signals to the control device CU, depending on whether the yarn store size falls below a predetermined boundary or exceeds another, predetermined boundary. Depending on signals ot sensors Sl, S2, respectively, or on signals of the associated textile machine, control device CU is controlling the winding drive 3 with the help of microprocessor MP such that said winding element 2 is rotated in the winding direction 5 to replenish the yarn store or to stop said winding element 2 for a resting period. Usually, the winding drive 3 is electrically braked to stop. Optionally, prior to the true stop the winding drive is further rotated in winding direction over a predetermined rotational angle or for a predetermined period of time at a crawl speed. Said winding drive 3 constitutes an electric motor backturn detent system D of the feeding device F which is actuatable by control device CU.

FIG. 1 shows a part of the feeding device F to explain its basic function. Said feeding device F could be equipped with a yarn braking device downstream of windings 6 and could serve to feed the yarn Y to a projectile or a gripper weaving machine (not shown). For a jet weaving machine (not shown), e.g. an air jet or a water jet weaving machine, said yarn feeding device F would be designed as a measuring feeding device releasing a yarn section of predetermined length for each insertion cycle. Then, a stopping device which is moveable between a release position and a stop position co-acts with the storage body 4. Detecting devices at the yarn feeding device F survey the release of a predetermined number of windings defining said yarn length. In this case the storage body could be designed with a variable diameter or with a fixed diameter. All these features are conventional.

The above-mentioned backturn detent system D has to hinder backturning of the winding element 2 in case of a stop of the winding drive 3 so that the yarn Y along its yarn path through winding element 2, 2a up to the storage body 4 cannot get loose. Backturn motion could be caused by residual tension in the yarn Y in said stop condition. Said tension tends to rotate winding element 2 backwards via the lever arm formed at the exit of winding element 2. A backturn torque also can result from elastic components K of said yarn feeding device which components act in the stop condition of winding element back into winding drive 3. Said components could be resilient dust sealings adjacent to winding element 2 and/or within storage body 4, e-g. if storage body 4 is equipped with conventional yarn winding separating advancing elements indirectly driven by the winding drive 3.

The operation of the backturn detent system D is as follows:

Upon the stop of winding element 2 at the beginning of a resting period a holding torque, preferably of constant magnitude, is adjusted within winding drive 3 and is maintained during the resting period. The holding torque is adjusted only so that no further rotation occurs in the winding drive 3 in winding direction 5, and also so that the winding element 2 is not rotated backwards under the influence of a backturn torque.

If the winding drive 3 is equipped with an asynchronous motor controlled by pulse width modulation, the holding torque is controlled at the stop with a frequency which is elevated in relation to the control frequency shortly before stop by a multiple, e.g. a factor of 10 or more, while simultaneously the voltage is correspondingly lowered. If during the slow crawl speed phase to the final stop thefrequency was about 0.5 Hz, the frequency is raised for the holding torque to 5.0 to 10 Hz, in order to avoid an undesired step function. Said holding torque is expediently switched on when the electric speed has reached the value zero, i.e., at a point in time at which the mechanical speed is not yet zero, or when stop has not yet occurred, respectively. To switch on said holding torque, e.g. voltage can be applied which amounts between 2% and 5% of the nominal operation voltage. The holding torque can be switched on in correspondence with an electric speed of e.g. only 1% of the maximum electric speed and such that the winding element does not rotate further after the stop. Optimally, the holding torque active in the winding direction should be switched on very shortly after the mechanical stop, e.g. only a few milliseconds later, in order to use the given relatively high mechanical, friction depending starting torque automatically following the stop. However, switching on the holding torque exactly at stop or prior to stop also is useful.

Figure 2:
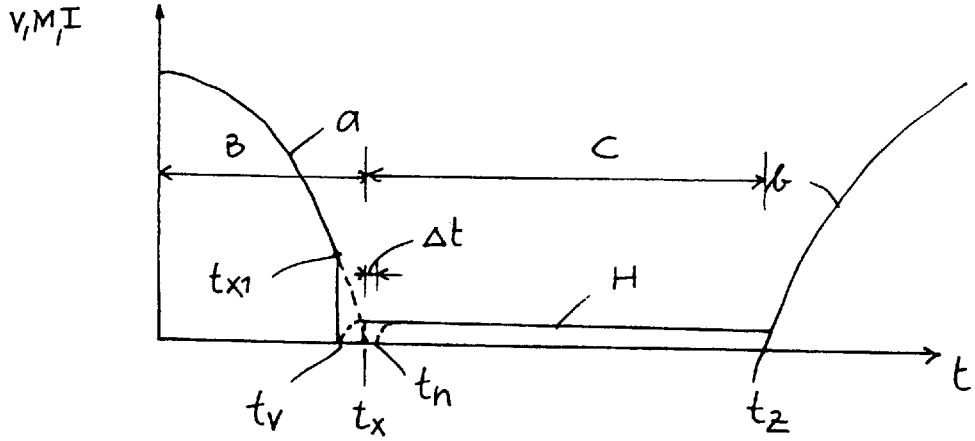
FIG. 2 is a diagram representing the operational behavior of the feeding device.

FIG. 2 the horizontal axis is the time axis while the vertical axis represents speed, torque or the current for the winding drive 3. A starting range B corresponds to a running phase followed by a resting period C again followed by a new running phase B. According to curve a the electric speed of the winding drive first is dropplng steeply because of electrical braking. At a point tV in time or at a point tX1 the electrical speed has reached zero. The mechanical speed is dropping to the actual stop at point tx. During the resting period C the holding torque H is maintained with constant magnitude. Said holding torque H has been switched on either at point tV in time, i.e., prior to stop tX or with the mechanical stop at point tx in time, or by a time difference Δt after point tn in time. At point tZ in time the winding drive is started again in the winding direction and its speed then follows curve b.

As it is conventional for yarn feeding devices the winding drive can be selectively driven in both rotational directions, in order to process yarns with S or Z-twist. The holding torque H is generated in the respective winding direction, however, only with a strength which avoids further rotation of the winding drive in the winding direction 5 but hinders any backturning.

Figure 3:
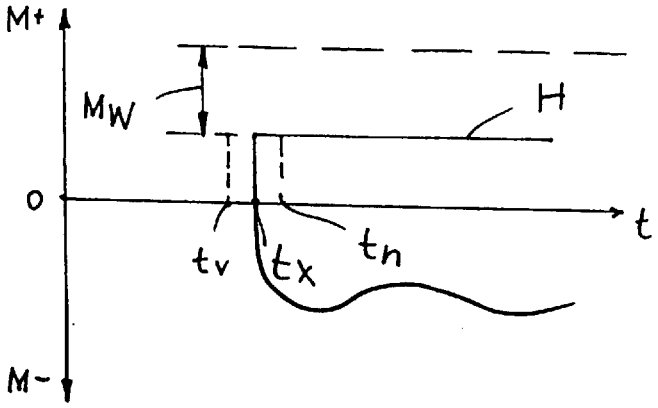
FIG. 3 is a further diagram illustrating the method according to the invention.

In FIG. 3 it is indicated over time axis t that holding torque H is adjusted in the winding direction with constant strength, starting at stop tX or prior or after the stop at points tV or tn, and how the holding torque is acting together with the system depending rotational resistance MW of the winding drive and the components of the yarn feeding device coupled with the winding drive to compensate for the negative backturn torque R occuring at stop (point tX in time). The effective backturn torque may vary. However, it does not overcome the sum of the holding torque and the mechanical rotational resistance MW in the backturning direction. Holding torque H is adjusted so that it does not overcome the mechanical rotational resistance MW in the winding direction. As a result, during the resting period the winding drive maintains a condition in which it is statically biased in the winding direction, however, the winding drive neither rotates in the winding direction nor in the opposite direction.

If holding torque H nevertheless should cause a rotation of the winding drive in the winding direction, for safety reasons a signal of sensor S1 the can be used by control device CU in FIG. 1 to cancel or reduce the holding torque H.

Said backturn detent system D can be used for feeding devices equipped with a stationary or a rotatable storage body. Feeding devices having said backturn detent system D could be employed as well for other yarn processing machines than the ones mentioned.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A method for preliminarily storing yarn on a drum-shaped storage body of a feeding device wherein yarn is wound in a predetermined winding direction onto the storage body to form windings by an electric winding drive which causes relative rotational movements between a winding element and the storage body, said method comprising the steps of:

interrupting the relative rotational movements between the winding element and the storage body to define resting periods;

rotatably driving the winding drive in the winding direction to a stop at a slow crawl-speed for a predetermined period of time or over a predetermined rotational angle, said stop defining the beginning of a said resting period; and electrically generating a holding torque within the winding drive and in the winding direction at the beginning of each resting period and maintaining said holding torque during said resting period without further rotation of the winding drive in the winding direction.

2. The method of claim 1 further including adjusting said holding torque to have a constant magnitude by a holding current or a holding voltage.

3. The method of claim 1 further including generating said holding torque timewise exactly at the mechanical standstill of the winding drive.

4. The method of claim 1 further including adjusting the magnitude of said holding torque depending upon at least one of the yarn quality and the mechanical rotational resistance of the winding drive and components mechanically coupled therewith.

5. A method for preliminarily storing yarn on a drum-shaped storage body of a feeding device wherein yarn is wound in a predetermined winding direction onto the storage body to form windings by an electric winding drive which causes relative rotational movements between a winding element and the storage body, said method comprising the steps of:

interrupting the relative rotational movements between the winding element and the storage body to define resting periods, the beginning of each resting period being defined by stoppage of the winding drive;

electrically generating a holding torque within the winding drive and in the winding direction during each resting period substantially without further rotation of the winding drive in the winding direction;

providing an asynchronous motor for the winding drive and controlling the asynchronous motor with pulse width modulation; and prior to stoppage of the winding drive, adjusting said holding torque so that the modulation frequency is elevated in relation to the control frequency by a factor of at least about 10 and simultaneously reducing the voltage to about 2% to about 5% of the nominal operation voltage.

6. A method for preliminarily storing yarn on a drum-shaped storage body of a feeding device wherein yarn is wound in a predetermined winding direction onto the storage body to form windings by an electric winding drive which causes relative rotational movements between a winding element and the storage body, said method comprising the steps of:

interrupting the relative rotational movements between the winding element and the storage body to define resting periods;

using the winding drive as a backturn detent device by electrically generating a holding torque within the winding drive and in the winding direction during each resting period without further rotation of the winding drive in the winding direction;

providing an electric control device connected to the winding drive and having a microprocessor including at least one program routine which adjusts the holding torque by adjusting one of a holding current and a holding voltage during a said resting period.

7. The method of claim 6 wherein said holding torque biases said winding drive in the winding direction to prevent further rotation of the winding drive in the winding direction and to additionally prevent backturning of the winding drive.

8. The method of claim 2 further including rotatably driving the winding drive in the winding direction to a stop at a slow crawl speed, said stop defining the beginning of a said resting period, and generating said holding torque at the beginning of each said resting period and maintaining said holding torque during said resting period to prevent rotation of said winding drive in the winding direction and to additionally prevent backturning of the winding drive.

* * * * *